US006230410B1

(12) United States Patent
Taylor et al.

(10) Patent No.: US 6,230,410 B1
(45) Date of Patent: May 15, 2001

(54) WALL TRIMMER FOR CARPET AND VINYL FLOOR COVERINGS

(75) Inventors: Raymond N. Taylor, Signal Mountain, TN (US); Martin L. Anderson, Maple Lake, MN (US)

(73) Assignee: National Carpet Equipment, Inc., Brooklyn Park, MN (US)

( * ) Notice: Subject to any disclaimer, the term of this patent is extended or adjusted under 35 U.S.C. 154(b) by 0 days.

(21) Appl. No.: 09/489,881

(22) Filed: Jan. 21, 2000

(51) Int. Cl.[7] ..... B26B 29/06
(52) U.S. Cl. ..... 30/293; 30/294
(58) Field of Search ..... 30/293, 294, 287

(56) References Cited

U.S. PATENT DOCUMENTS

| | | | | |
|---|---|---|---|---|
| 2,772,474 | * | 12/1956 | Hill et al. | 30/293 |
| 3,605,267 | * | 9/1971 | Brenner | 30/293 X |
| 3,934,341 | | 1/1976 | Carlson | 30/287 |
| 3,934,342 | | 1/1976 | Matsushita | 30/293 |
| 4,001,936 | | 1/1977 | Matsushita | 30/287 |
| 4,064,627 | | 12/1977 | Zanfini | 30/287 |
| 4,095,341 | | 6/1978 | Crain | 30/287 |
| 4,130,939 | | 12/1978 | Toal | 30/293 |
| 5,044,081 | | 9/1991 | Nguyen | 30/294 |
| 5,450,672 | | 9/1995 | Fortin | 30/273 |
| 5,946,808 | | 9/1999 | Martinez | 30/290 |

* cited by examiner

*Primary Examiner*—Douglas D. Watts
(74) *Attorney, Agent, or Firm*—Nikolai, Mersereau & Dietz, P.A.

(57) ABSTRACT

The wall trimmer for carpet and vinyl floor coverings is a hand tool for cutting floor coverings flush to the wall. The wall trimmer may be used in both directions along walls, and may be used right or left handed. The wall trimmer includes a base plate that allows the wall trimmer to be slid on the surface of floor coverings. The base plate is wide and flat, which stabilizes the tool for true cuts along the walls. There is also a handle assembly that is used to move the wall trimmer along its path, which is attached to the base plate. The handle assembly can be easily angularly adjusted for different jobs. The wall trimmer also includes a blade guide assembly that retains a pair of blades that are used to cut the floor covering. The blades are retained at an angle of about 15 to 25 degrees from the base plate. This shallow angle allows for good cutting with little effort. The blades are also crossed so that the trimmer is able to cut floor coverings closer to the corners of rooms. In addition, there are multiple depth settings for the blades for different types of floor coverings that may be cut. The wall trimmer also includes a mounting assembly on the base plate on which the blade guide assembly is mounted. This mounting assembly allows the blade guide assembly to be mounted at different heights for different piles of carpeting or different floor coverings, and may be done quickly and easily without having to disassemble the wall trimmer.

18 Claims, 6 Drawing Sheets

WALL TRIMMER FOR CARPET AND VINYL FLOOR COVERINGS

BACKGROUND OF THE INVENTION

1. Field of the Invention

This invention relates generally to hand tools and more particularly is directed towards a tool for cutting carpet and vinyl floor coverings flush to the wall.

2. Discussion of the Prior Art

Carpet and vinyl floor covering cutters are well known in the prior art. In fact, there are many variations of such cutters in the prior art. A narrow category within the prior art is cutters specifically designed to trim floor coverings near a wall. However, there are still quite a number of cutters for just that purpose. None of these wall cutters are like the claimed invention, however, which has novel, unique and very useful features.

One example of a cutter used to cut floor coverings near a wall is in Codainne, U.S. Pat. No. 2,666,986, issued on Jan. 26, 1954, for Carpet Cutting Device. The device disclosed is a carpet cutter in which a top plate has a downwardly extending guide member abutting against a wall to guide the cutter in its cutting movement. The front end portion of the top plate is formed with an angular slot for receiving the upwardly extending turned portion of the carpet to be trimmed.

Another example is Brenner, U.S. Pat. No. 3,605,267, issued on Sep. 20, 1971, for Carpet Trimming Tool, which discloses a carpet trimmer with a flat base for riding on the nap or pile of a carpet. Mounted to the base plate are oppositely directed cutting blades. The oppositely directed cutting blades are disposed adjacent a guide member.

In Carlson, U.S. Pat. No. 3,934,341, issued on Jan. 27, 1976 for Carpet Cutting Tool, there is disclosed a carpet trimmer that has a body with a guide attached to it that extends in spaced relation to the forward edge of the body to engage a base board. The trimmer is moved in a direction parallel to the baseboard and parallel to the plane of the cutting blades, and cuts the floor covering a certain distance from the wall.

In Nguyen, U.S. Pat. No. 5,044,081, issued on Sep. 3, 1991, for Carpet Trimmer with a Recessed Guide, there is disclosed a carpet trimmer that includes an angularly disposed upper plate spaced from the bottom plate to form an angular recess facing an installed molding. The angular recess receives a projecting edge on the installed molding during the cutting of the carpet, which guides the Trimmer along the molding.

In Zanfini, U.S. Pat. No. 4,064,627, issued on Dec. 27, 1977, for Carpet Cutter, there is disclosed a carpet cutter having a base, a frame carrying downwardly diverging blades, and a handle.

In Matsushita, U.S. Pat. No. 4,001,936, issued on Jan. 11, 1977, for Carpet Cutter, there is disclosed a carpet cutter that is used to cut any excess edges of a carpet to the size of a room after it has been laid in the room. The carpet is cut at its bend toward the wall. There is one blade in the cutter that is slantly mounted for cutting the carpet near the wall.

Finally, in Crain, U.S. Pat. No. 4,095,341, for Carpet Trimmer, there is disclosed a carpet trimmer with a base plate. Slots are formed in the base plate at right angles to the working edge of the base plate. Cutting blades are mounted over the base plate. A wall guide depends from a blade holder for the cutting blades in spaced relation to the working edge of the base plate to form a passageway for a carpet edge to be trimmed. The trimmer uses a stack of spacer members for adjusting the height of a blade in the carpet trimmer, which is noted as being well-known in the art.

The present invention can be distinguished from the prior art, and is novel, non-obvious, and useful in light of the prior art. First, the present invention works with all types of carpet, carpet backing and vinyl floor coverings to trim them flush to the wall. Second, it has a wider platform on the bottom, which stabilizes the entire tool for more true cuts along the walls. Third, the blades cut at an angle of 15 to 25 degrees to the base plate, which improves the cutting and requires less effort. In addition, the blades will last 2 to 3 times longer as a result of the angle. Fourth, the blades cross over each other. This allows the cutting edges of the blades to be closer to the center of the trimmer, which results in the trimmer being able to cut floor coverings more closely to the corners of the room. Therefore, less of the floor covering must be cut by hand with a knife to complete the corners. Fifth, the handle quickly adjusts to any angle, and can be used right or left handed. Sixth, the height adjustment for different piles of carpeting or different floor coverings is quick and easy. It does not require disassembly of the tool to adjust the cutting height. Seventh, it has multiple blade depth settings. Overall, the present invention is novel, non-obvious and useful.

DESCRIPTION OF THE FIGURES

The foregoing features, objects and advantages of the invention will become apparent to those skilled in the art from the following detailed description of a preferred embodiment, especially when considered in conjunction with the accompanying drawings in which like numerals in the several views refer to corresponding parts.

SUMMARY OF THE INVENTION

The present invention is a floor coverings cutter specifically designed for cutting floor coverings near walls. In its simplest form, the wall trimmer comprises a generally planar base plate adapted to be slid on floor coverings. A handle assembly is attached to said base plate for moving said wall trimmer along a path. The device further includes a blade guide assembly retaining a pair of blades, and a mounting assembly for mounting said blade guide assembly on said base plate.

DESCRIPTION OF THE PREFERRED EMBODIMENT

Figure 1:
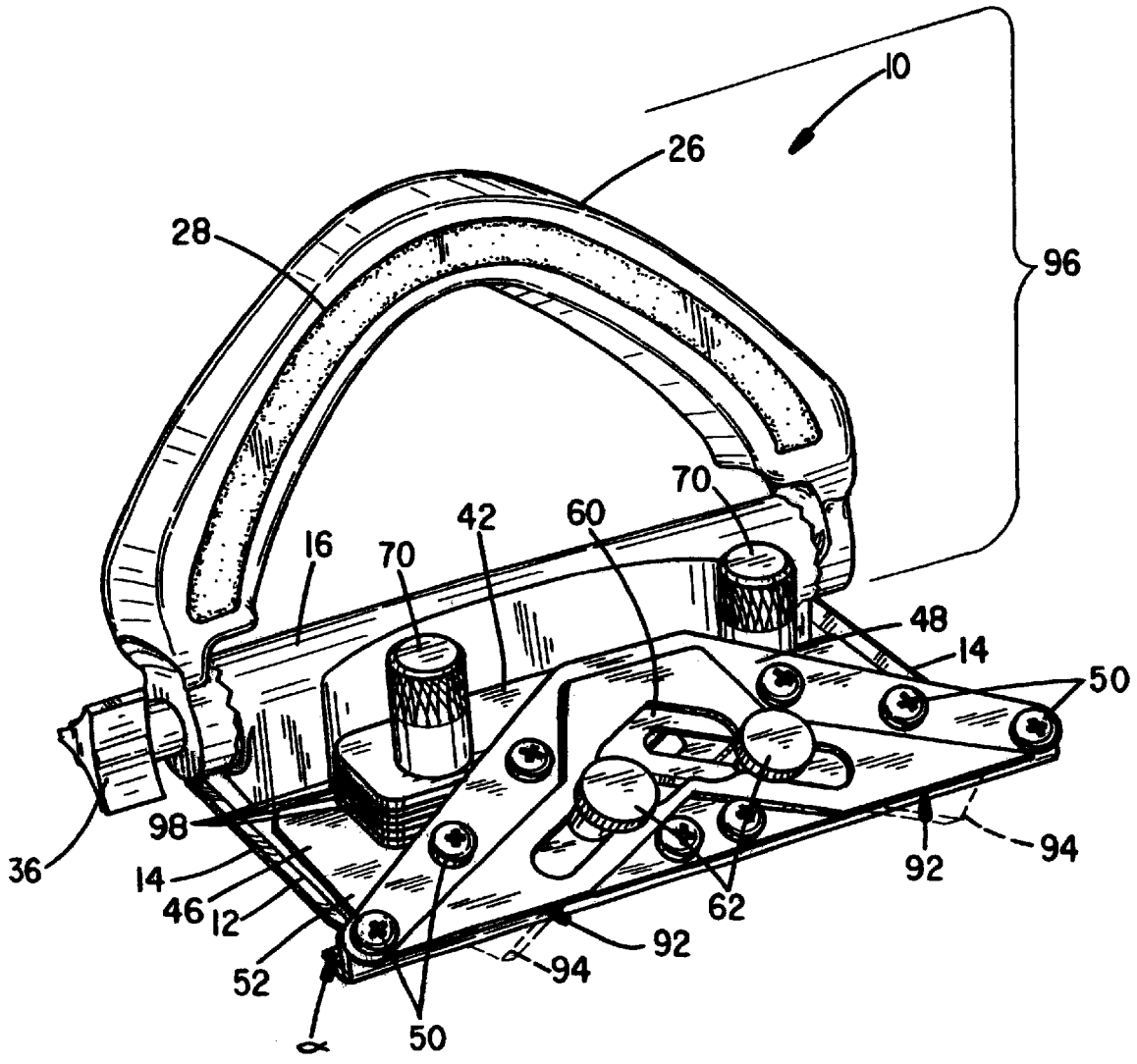
FIG. 1 is a view in perspective of the wall trimmer for carpet and vinyl floor coverings according to the invention.

Referring to the drawings, there is indicated generally by numeral 10 a wall trimmer for carpet and vinyl floor coverings constructed in accordance with the present invention. (FIG. 1). The wall trimmer 10 is adapted to be slid on the surface of such floor coverings. It has a wide and relatively flat base plate 12 that is generally planar. (FIGS. 1, 2, 3 and 6). The base plate 12 is made of a suitable rigid material. The base plate 12, in the preferred embodiment, has a rectangular configuration. At each end thereof, the base plate 12 has an upturned lip 14. (FIGS. 1, 2, 3, 4 and 6). In practice, the wall trimmer is caused to travel in either direction perpendicular to the upturned lips 14, and the upturned lips 14 serve to reduce the snagging or catching of the carpet or vinyl floor covering on the ends of the base plate 12. The base plate 12 is sufficiently wide to stabilize the tool for more true cuts along walls.

Figure 4:
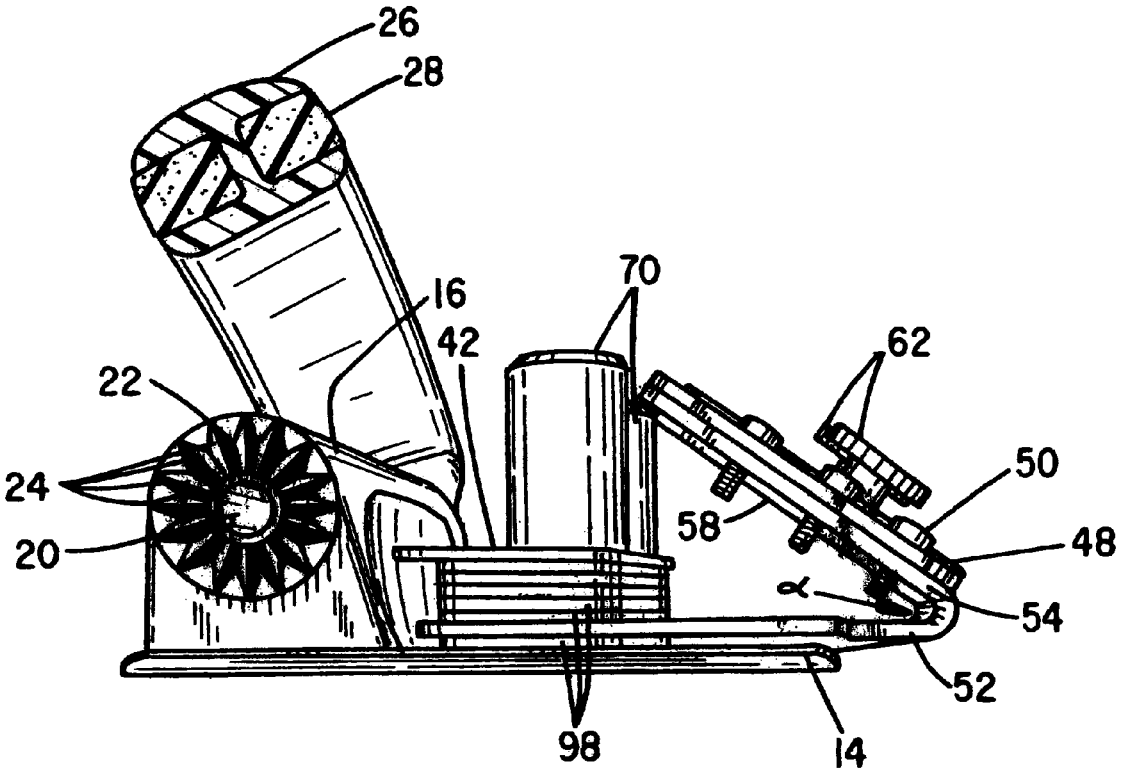
FIG. 4 is an end view of the wall trimmer with the handle broken away to illustrate the end of the handle base and the handle itself.
Figure 6:
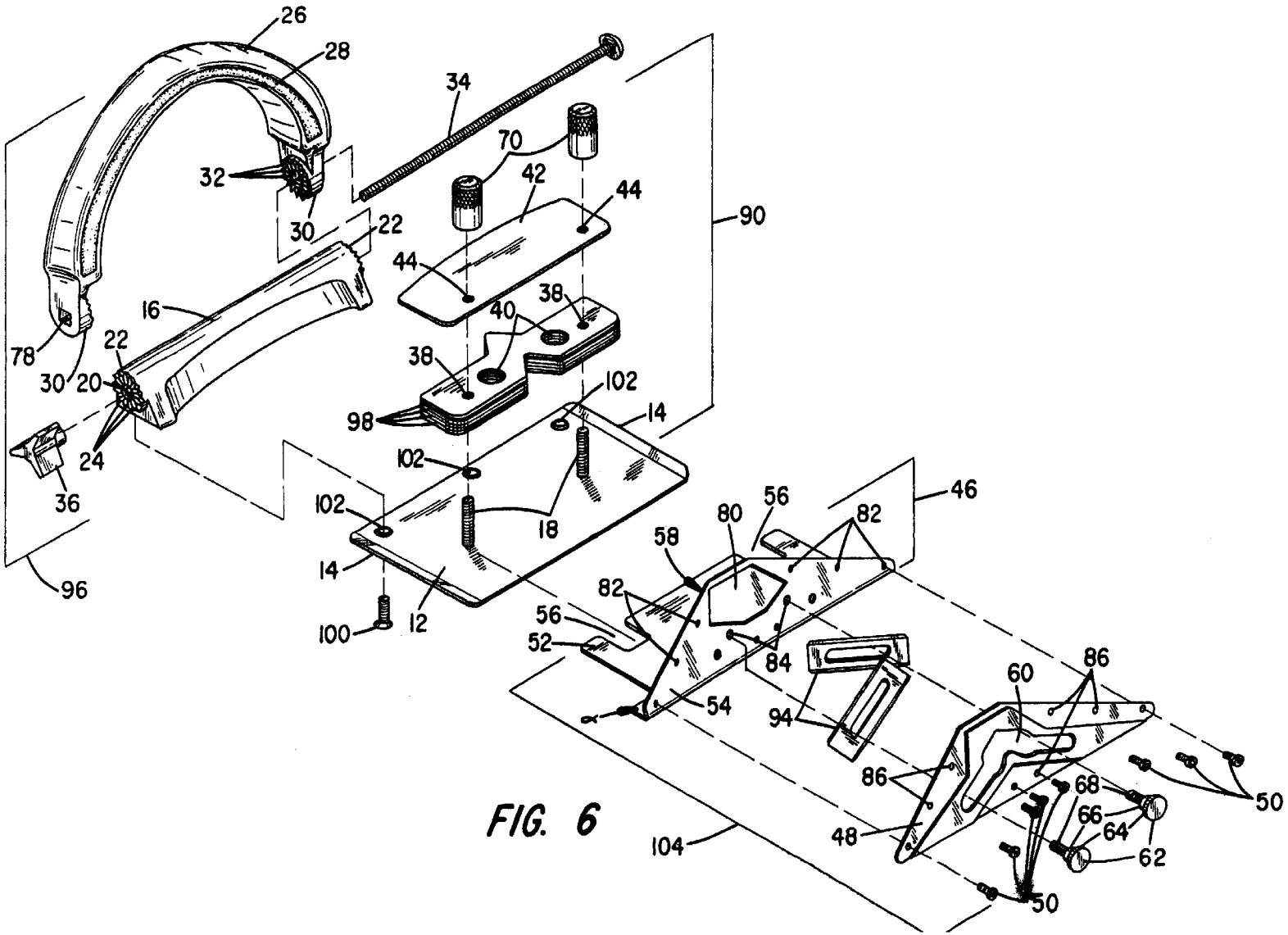
FIG. 6 is an exploded assembly view of the wall trimmer as shown in FIG. 1.

The wall trimmer also includes a handle assembly 96 that is used to move it along its path. (FIG. 6). In the preferred embodiment, along the rear edge of the base plate 12 is secured a handle base 16. (FIGS. 1, 2, 4 and 6). In the preferred embodiment, the handle base is secured to the base plate 12 by a number of screws 100 and preferably with three screws 100, and with those three screws 100 going through three holes 102 in the base plate 12 and into the handle base 16. (FIG. 6). The handle base 16 is made of a suitable rigid material, like plastic. The handle base 16 has a bore or passage 20 through its center. (FIGS. 4 and 6). The ends 22 of the handle base 16 each have a circular array of ratchet detent teeth 24. (FIGS. 4 and 6).

Figure 2:
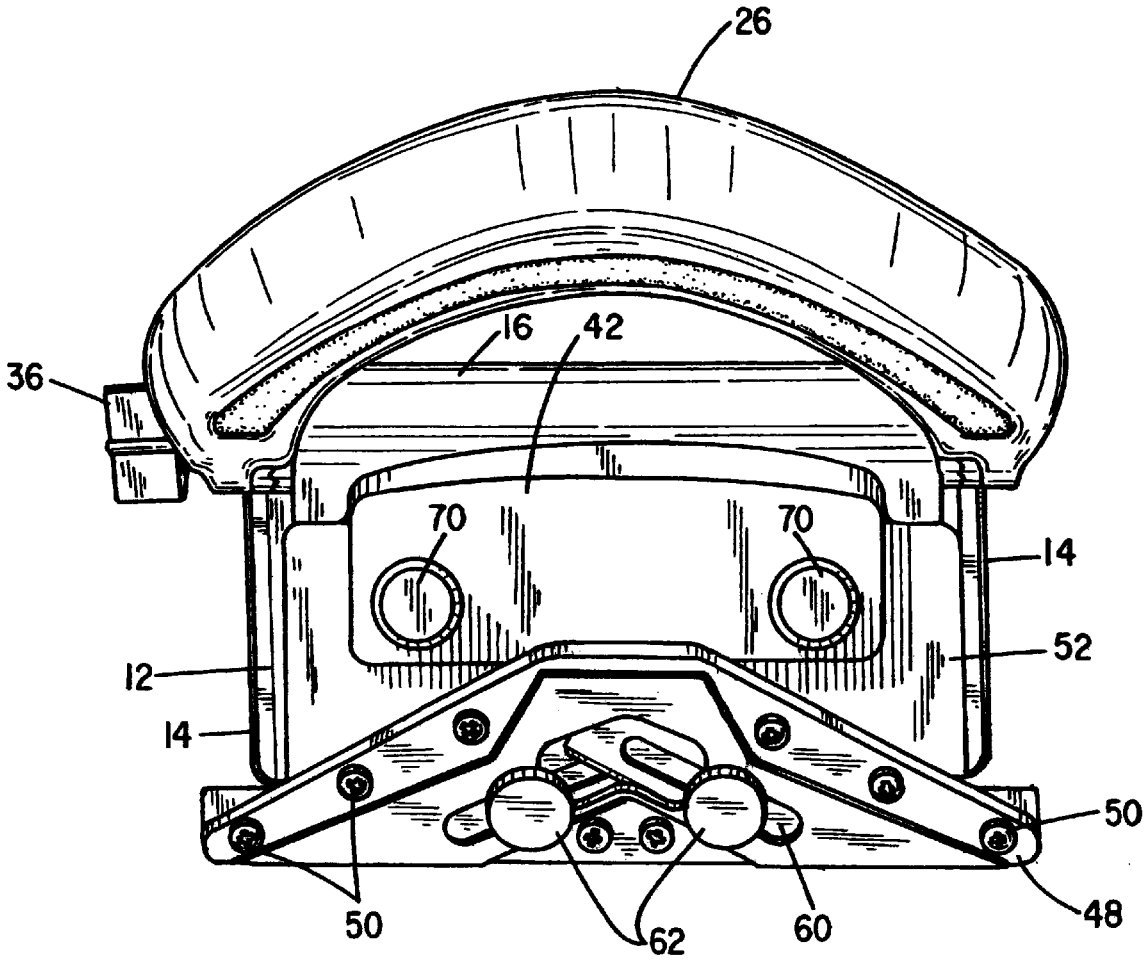
FIG. 2 is a top view of the wall trimmer.
Figure 3:
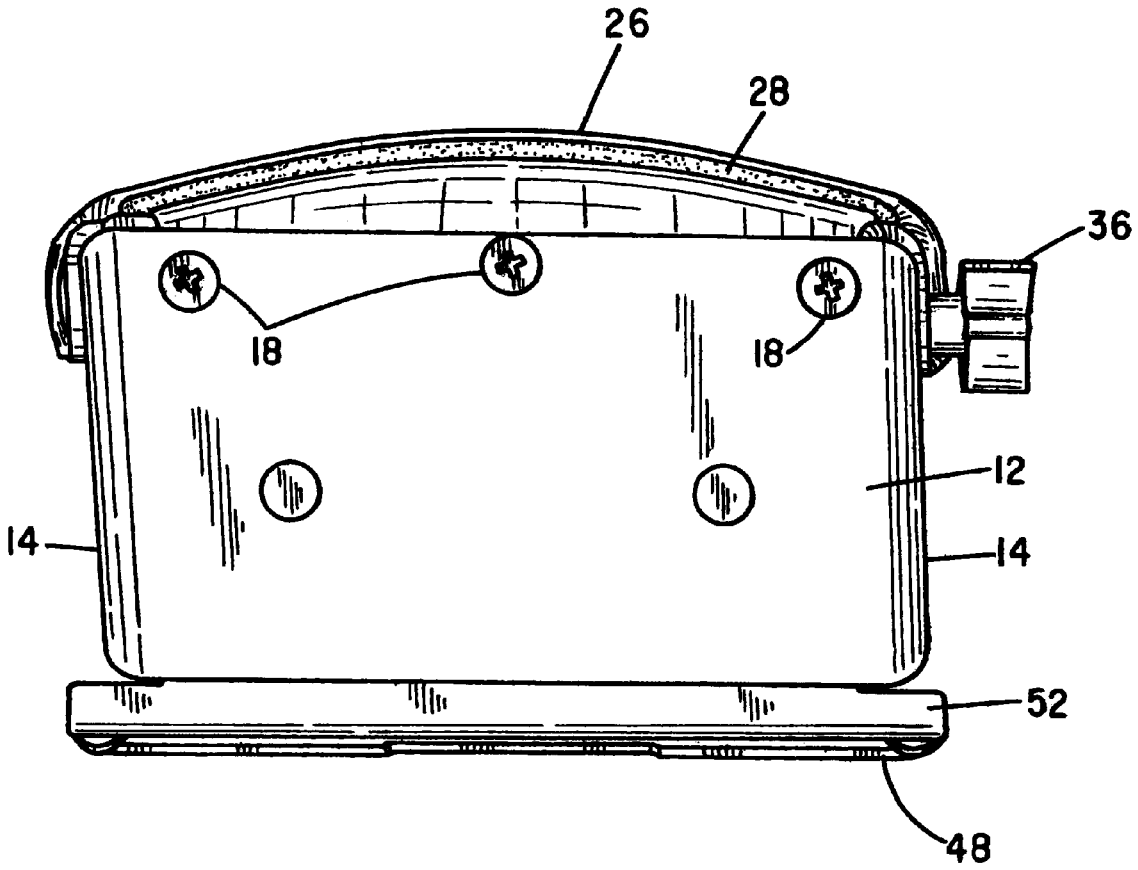
FIG. 3 is a bottom view of the wall trimmer.

The handle 26 is in a wide, inverted, generally v-shape. (FIGS. 1, 2 and 6). The symmetrical shape of the handle 26 allows it to be used either left handed or right handed. In the preferred embodiment, the handle 26 is mostly made of a suitable rigid material like plastic, just like the handle base 16. In the preferred embodiment, an inner cavity 28 runs down the handle 26. (FIGS. 1, 4 and 6). This inner cavity 28, along the handle's 26 length, is filled with a foam rubber having a high coefficient of friction. The foam rubber improves the grip of the worker on the wall trimmer 10, and prevents the wall trimmer 10 from slipping out of the hand of the installer. This non-slip, ergonomic handle 26 is known as the COMFORT GRIP™.

The handle 26 is mounted on the handle base 16. (FIGS. 1, 2 and 6). The ends 30 of the handle 26 fit together with the ends 22 of the handle base 16 by fitting around the outside of and opposing the ends 22 of the handle base 16. (FIGS. 1 and 6). The handle 26 is angularly adjustable by including a circular array of ratchet detent teeth 32 for locking engagement with the cooperating circular set of ratchet detent teeth 24 on the ends 22 of the handle base 16. (FIGS. 4 and 6). The ends 30 of the handle 26 and the ends 22 of the handle base 16 have openings (78 and 20, respectively) to receive a threaded handle bolt 34 therethrough and to which is connected a thumb knob 36. (FIGS. 4 and 6). The handle bolt 34 goes through the passage 20 in the handle base 16. (FIG. 6). The angular position of the handle 26 may be adjusted by backing off of the thumb knob 36 sufficiently to disengage the ratchet detent teeth (24 and 32) and to select the angle best suited to the particular job. Once the angle has been set, the thumb knob 36 on the handle bolt 34 is tightened and the handle 26 is again clamped tightly in a locked position. The angular adjustment of the handle 26 to the desired position can be done very quickly and easily.

The next part of the wall trimmer 10 is the mounting assembly 90. (FIG. 6). Connected to the center of the base plate 12 are upstanding, threaded posts 18, preferably a pair of them, in spaced apart relation. (FIG. 6). Removably mounted on the posts 18 is a stack of flat height adjusting spacer plates 98. (FIGS. 1, 4 and 6). In the preferred embodiment, the height adjusting spacer plates 98 are made of a suitable rigid material, are generally rectangular in shape, and are formed with suitable openings 38 therethrough to receive the upstanding, threaded posts 18. (FIG. 6). In the preferred embodiment, however, the spacer plates 98 are generally rectangular in shape with a triangular notch cut out near the middle and with that same shape and size of triangle extending from the top portion of the plate. (FIG. 6). There are also additional holes 40 therethrough in the preferred embodiment. (FIG. 6).

In the preferred embodiment, there are six individual removable spacer plates 98. (FIGS. 1, 4 and 6). One of the spacer plates is colored black, whereas the others are silver or the color of the material used to make them. Seated on the stack of spacer plates 98 in overlying relation is a removable cover plate 42 that is flat and made of a suitable rigid material, and has two suitable openings 44 therethrough to receive the upstanding, threaded posts 18. (FIGS. 1,4 and 6). The cover plate 42 is slightly larger in size than the spacer plates 98. In the preferred embodiment, the cover plate 42 is generally rectangular in shape with the top edge being curved and not flat. The cover plate 42 is generally used to improve the appearance of the wall trimmer 10, therefore it is optional.

The height of the blades for the wall trimmer relative to the base plate 12 is adjusted by placing the blade guide assembly 104, in between certain spacer plates 98. (FIG.6). This can be done quickly and easily.

The blade guide assembly 104 is interleaved into the stack of spacer plates 98 and adjustably retains a pair of blades 94 used for trimming carpet or vinyl floor coverings. (FIGS. 1, 2, 4 and 6). The blade guide assembly 104, in the preferred embodiment, comprises a base piece 46, blade cover plate 48 and blade cover plate screws 50. (FIG. 6). The blades 94 are retained in the blade guide assembly 104.

The base piece 46 is made of a suitable rigid material, and has two portions 52 and 54, the second portion 54 of which is bent at a predetermined angle, $\alpha$, to the first portion 52. (FIGS. 1, 4 and 6). The angle is at the front portion of the wall trimmer. The predetermined angle, $\alpha$, is preferably in a range from about 15 to 25 degrees. This shallow angle results in a smooth cut edge. The shallow angle also requires less force on the wall trimmer 10 to advance the tool through the floor covering, which reduces operator effort. In addition, the blades 94 in the wall trimmer last 2 to 3 times longer as a result of the shallow angle.

There is a pair of notches 56 in the rear edge of the first portion 52 of the base piece 46 that are in spaced apart relation. (FIG. 6). The notches 56, preferably in a square shape, allow the blade guide assembly 104 to be interleaved or fit into the stack of spacer plates 98, while leaving space for the posts 18 on which the stack of spacer plates 98 are removably mounted. (FIG. 6). The blade guide assembly 104 is placed and retained in between certain spacer plates 98 depending upon the desired height of the blades relative to the base plate 12 for the particular job. The notches 56 allow the blade guide assembly 44 to be easily removed from the stack of spacer plates 98, and replaced in the stack where the desired height for the particular floor coverings results, without disassembling the wall trimmer 10. (FIG. 6).

Figure 5:
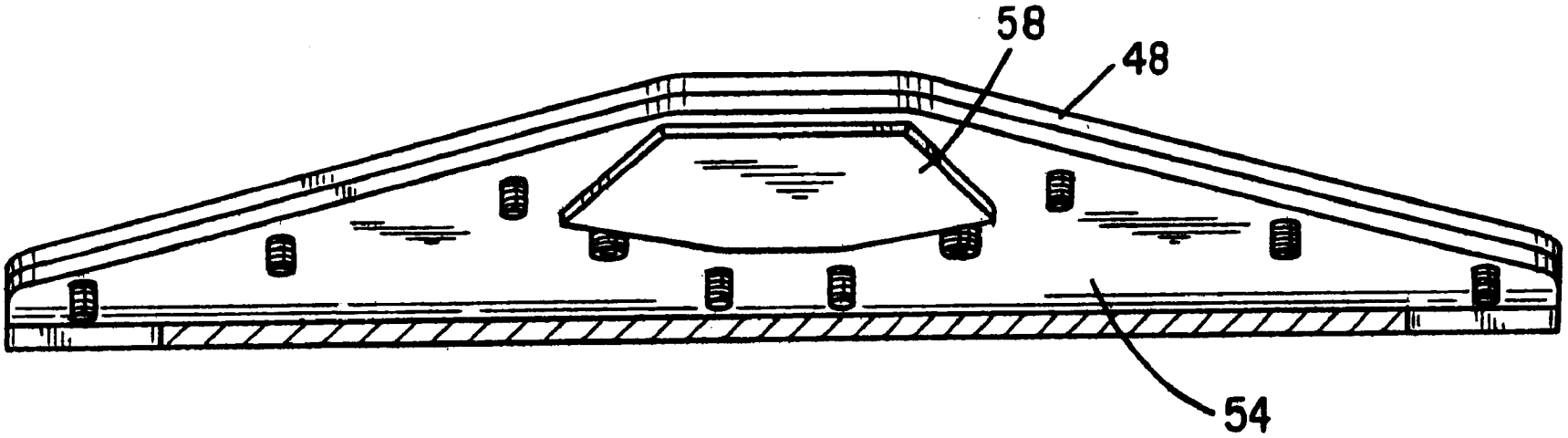
FIG. 5 is a view from the back side or rear edge of the wall trimmer with the rear portion broken away to illustrate the back side of the blade guide assembly.

In the preferred embodiment, the second portion 54 of the base piece 46 tapers slightly as it goes upward. (FIGS. 5 and 6). The resultant shape of the second portion 54 is a wide, truncated triangle. A part in the middle of the second portion 54 is cut out 80 through its thickness dimension. (FIG. 6). In the preferred embodiment, the cut out or hole 80 is in the shape of a polygon with six sides. Another piece of the same material in exactly the same shape 58, but only in a slightly larger size, is welded or connected to the bottom side of the second portion 54 directly over the cut out portion 56. (FIG. 5). This provides some space in the blade guide assembly 104 for the blades 94 to be retained. The second portion, in the preferred embodiment, also has holes 82 in it to receive the blade cover plate screws 50. (FIG. 6). In the preferred embodiment, there are eight holes 82 to receive eight blade cover plate screws 50. (FIG. 6). The second portion 54 also has four apertures 84 through it that are located just below the cut out portion 80.

The blade slots or channels 92 (FIG. 1) are further formed by the stamping of the blade cover plate 48. The blade cover plate 48 is stamped in the wide, inverted generally v-shape to create the space necessary to allow the blades 94 to overlap or cross over each other and to extend obliquely downward. The openings of the slots 92 are at the bottom of the blade cover plate 48.

The blade cover plate 48 of the blade guide assembly 104 is of a complimentary shape to the second portion 54 of the base piece 46 of the blade guide assembly 44. (FIGS. 4 and 6). The blade cover plate 48 is also fixed to the second portion 54 of the base piece 46, preferably by a number of blade cover plate screws 50. (FIGS. 1, 2, 4 and 6). There are eight holes 86 in the blade cover plate 48. (FIG. 6). The preferred embodiment includes eight blade cover plate screws 50. Six of the blade cover plate screws 50 line the top edge of the second portion 54 and the blade cover plate 48, while the other two blade cover plate screws 50 are located at the bottom of the blade cover plate 48 and on the second portion 54 near the bend in the base piece 46. The blade cover plate screws 50 go through the blade cover plate holes 86 and the holes 82 in the second portion 54. (FIG. 6).

The blade cover plate 48 also has a portion cut out 60 through its thickness dimension. (FIGS. 2 and 6). The cut out portion 60 is generally an inverted, wide v-shape, in the preferred embodiment. This cut out portion 60 allows the user to see and access the blades 94, that fit in between the second portion 54 and the blade cover plate 48 in what are two blade slots, effectively 92. The shape is necessary because the two blades that are used in the wall trimmer 10 cross over each other and extend downward.

The crossing-over and resulting close proximity of the cutting ends of the blades 94 allow the wall trimmer 10 to cut floor coverings closer to the corners of rooms.

In order to secure the blades in the wall trimmer 10, blade securing knobs 62 are used. (FIGS. 1, 2, 4 and 6). The blade securing knobs 62 go through the blades 94 and two of the four apertures 84 in the second portion 54 to secure the blades 94 in the wall trimmer 10. The apertures 84 that are used depend upon the type of blade used and whether or not the particular blade is extended or not. The blade securing knobs 62 include a knurled head 64 to facilitate gripping and a stepped shoulder 66 of a lesser diameter leading to an externally threaded stem 68. (FIG. 6). When the stem 68 is screwed through the slot in one of the blades and into the holes 84 in the second portion 54, the stepped shoulder 66 presses against one of the slotted blades to compress it against the second portion 54 to provide a locking thereof and prevent the blades 94 from sliding. The blade securing knobs 62 are able to secure the blades 94 to the second portion 54 and the blade cover plate 48 with the blades completely inside or with the cutting edges of the blades extended a selected distance beyond the lower edge of the blade cover plate 48. This configuration allows the blades to be set to multiple depths for different floor coverings.

In order to keep the spacer plates 98, cover plate 42 and blade guide assembly 104 removably mounted to the posts 18 and further attached to the base plate 12, spacer knobs 70 are used. (FIGS. 1, 2, 4 and 6). In the preferred embodiment, two spacer knobs 70 screw onto the two threaded posts 18 to secure the other pieces together. The spacer knobs 70 are knurled on about the top half for gripping purposes.

Operation

In operation, the floor covering installer will remove the blade securing knobs 62 and insert a blade in one or both of the slots 92 formed in the blade guide assembly 104. The blades 94 are inserted in the bottom of the blade guide assembly 104 and slid upward by lightly pushing on the blade through the cut out portion 60. The most suitable blade will be chosen depending upon the particular floor covering that is going to be cut. For cutting soft vinyl or some thin commercial carpets, a hook blade may be used, while for all other floor coverings, a slotted blade may be used. After the blades are put into the wall trimmer 10, one of the blades 94 will be selected by the installer and extended down below the bottom of the blade cover plate 48 a set distance depending upon the desired cutting length for the particular job. The blades 94 are extended by lightly pushing on the blades through the cut out portion 60. One blade or the other will be selected depending upon whether the installer will be cutting left handed or right handed, and the desired direction of travel of the wall trimmer 10. Once the blade has been selected and extended below the blade cover plate 48, the blade securing knobs 62 will be replaced and tightened to secure the blades in place.

The installer will also loosen, but not remove, both spacer knobs 70 and remove the blade guide assembly 104 from its location in the stack of spacer plates 98. The installer will then insert the blade guide assembly 104 between the spacer plates 98 at the desired height for cutting the floor covering. After determining the proper height, the installer should firmly tighten the spacer knobs 70. The blade height determines where the blade will cut. If the placement of the blade guide assembly 44 leaves the carpet too long, then the blade guide assembly should be moved down a spacer plate 98 or two, and if the carpet is cut too short, then it should be moved up a spacer plate 98 or two.

The installer must also adjust the handle 26 for a particular job. The installer does this by loosening the thumb knob 36 and rotating the handle 26 in the handle base 16 to the desired angle. The thumb knob 36 should then be re-tightened to secure the handle 26 in the handle base 16.

To cut the carpet along a wall, the installer must first pre-crease the carpet or other floor covering into a corner using a corner of the wall trimmer 10 that is opposite the blade that will be used to do the cutting. The installer should then press the blade through the floor covering. The installer then should move the wall trimmer 10 in the forward direction, while keeping the base plate 12 flat on the carpet and the wall trimmer 10 against the wall as he or she cuts the floor covering. The wall trimmer 10 is able to cut the carpet very close to the corners of the floor coverings, but not completely into the corners because of the construction of the wall trimmer 10. Therefore, to complete the trimming at the corners, a hand knife may be used, or the wall trimmer 10 can be moved in the opposite direction, with the opposite blade, to complete the cut.

The wall trimmer 10 works on all polyurethane attached cushions, Actionbac® secondary backings, soft backings, vinyls and carpets. It also works well on commercial "unitary" carpets.

The wall trimmer 10 may also be disassembled for cleaning.

This invention has been described herein in considerable detail in order to comply with the patent statutes and to provide those skilled in the art with the information needed to apply the novel principles and to construct and use such specialized components as are required. However, it is to be understood that various modifications can be accomplished without departing from the scope of the invention itself. Hence the scope of the invention is to be determined from the appended claims.

What is claimed is:

1. A wall trimmer comprising:

a base plate adapted to be slid on floor coverings;

a handle assembly attached to said base plate for moving said wall trimmer along a path;

a blade guide assembly;

a pair of blades retained in said blade guide assembly; and a mounting assembly for mounting said blade guide assembly on said base plate, wherein said blade guide assembly comprises a base piece, a blade cover plate and blade cover plate screws, wherein said base piece is made up of a first and second portion with said first portion being relatively flat with two notches in spaced apart relation in the rear edge of said first portion, and said second portion being bent at a predetermined angle to said first portion at the front edge of said wall trimmer, and wherein said blade cover plate screws secure said second portion to said blade cover plate, which is in the complementary shape to said second portion of said base plate and is secured on the front side of said second portion.

2. The wall trimmer as claimed in claim 1 wherein said base plate is generally planar.

3. The wall trimmer as claimed in claim 2 wherein said base plate has a rectangular configuration.

4. The wall trimmer as claimed in claim 3 wherein said base plate has an upturned lip at each end thereof to reduce snagging or catching of floor coverings on said base plate.

5. The wall trimmer as claimed in claim 1 wherein said handle assembly is angularly adjustable.

6. The wall trimmer as claimed in claim 5 wherein said handle assembly is comprised of a handle base that is secured to the rear edge of said base plate, and is further comprised of a handle that is mounted on said handle base.

7. The wall trimmer as claimed in claim 6 wherein said handle is symmetrical so that said wall trimmer may be used either right handed or left handed.

8. The wall trimmer as claimed in claim 7 wherein said handle is in a wide, inverted v-shape.

9. The wall trimmer as claimed in claim 8 wherein said handle includes an inner cavity along its length that is filled with foam rubber.

10. The wall trimmer as claimed in claim 6 wherein the ends of said handle are comprised of a circular array of ratchet detent teeth for locking engagement with another cooperating circular set of ratchet detent teeth on the ends of said handle base, and wherein said ends of said handle fit together with said ends of said handle base by fitting around the outside of and opposing said ends of said handle base, and further comprising a handle bolt that passes through holes in said ends of said handle, and holes in said ends of said handle base and through a passage in said handle base, and connects to a thumb knob that is tightened to keep said handle in the desired position.

11. The wall trimmer as claimed in claim 1 wherein said predetermined angle is in a range from about 15 to 25 degrees.

12. The wall trimmer as claimed in claim 1 wherein said blades overlap each other and extend obliquely downward in said blade guide assembly.

13. The wall trimmer as claimed in claim 1 wherein a portion near the center of said second portion is cut out through its thickness dimension, and wherein said blade cover plate has a portion cut out through its thickness dimension, and wherein said blade cover plate is stamped, which together form slots in which said blades are retained, with openings of said slots being at the bottom edge of said blade cover plate, and for the extension of said blades, and wherein said second portion has two apertures through its thickness dimension, and further comprising two blade securing knobs that fit into said apertures and through said blades to secure said blades to said blade guide assembly.

14. The wall trimmer as claimed in claim 13 wherein said predetermined angle is in a range from about 15 to 25 degrees.

15. The wall trimmer as claimed in claim 13 wherein said blade securing knobs include a knurled head and a stepped shoulder with an externally threaded stem, which when said externally threaded stem is screwed through said blades and into said second portion of said base piece of said blade guide assembly, said stepped shoulder presses against said blades to compress said blades to said second portion.

16. The wall trimmer as claimed in claim 13 wherein said blades overlap each other and extend obliquely downward in said blade guide assembly.

17. The wall trimmer as claimed in claim 1 wherein said mounting assembly comprises a pair of upstanding, threaded posts in spaced apart relation secured to said base plate in about the center of said base plate, and further comprising a plurality of individual removable spacer plates that are stacked on said upstanding threaded posts through openings on said spacer plates, and wherein said blade guide assembly is placed in between said spacer plates in order to effect the desired height of said blades in said wall trimmer relative to said base plate, and further comprising spacer knobs that screw onto said upstanding, threaded posts to secure said blade guide assembly and said spacer plates on said upstanding, threaded posts.

18. The wall trimmer as claimed in claim 1 wherein said blades are adjustably retained in said blade guide assembly.

* * * * *

UNITED STATES PATENT AND TRADEMARK OFFICE

CERTIFICATE OF CORRECTION

PATENT NO. : 6,230,410 B1
DATED : May 15, 2001
INVENTOR(S) : Raymond N. Taylor and Martin L. Anderson It is certified that error appears in the above-identified patent and that said Letters Patent is hereby corrected as shown below:

Title page,
Please add as a second Assignee the following company:
-- Textile Rubber and Chemical Company, Inc.,
Dalton, GA (US) --

Signed and Sealed this

Second Day of April, 2002

*Attest:*

*Attesting Officer*

JAMES E. ROGAN
*Director of the United States Patent and Trademark Office*